United States Patent [19]

Timmerman et al.

[11] 3,986,877

[45] Oct. 19, 1976

[54] DEVELOPMENT PROMOTING COMPOUNDS FOR SILVER HALIDE PHOTOGRAPHY

[75] Inventors: Daniel Maurice Timmerman, Mortsel; Robert Joseph Pollet, Vremde; Jozef Frans Willems, Wilrijk; Walter Frans De Winter, Berchem, all of Belgium

[73] Assignee: AGFA-Gevaert, N.V., Mortsel, Belgium

[22] Filed: Aug. 8, 1974

[21] Appl. No.: 495,816

[30] Foreign Application Priority Data

Sept. 25, 1973 United Kingdom ..... 44829/73

[52] U.S. Cl. ..... 96/66.3; 96/95; 96/114

[51] Int. Cl.[2] ..... G03C 5/30; G03C 1/06; G03C 1/72

[58] Field of Search ..... 96/114, 94 BF, 95, 76, 96/66, 29

[56] References Cited

UNITED STATES PATENTS

| | | | |
|---|---|---|---|
| 3,647,439 | 3/1972 | Bass | 96/29 R |
| 3,655,380 | 4/1972 | Parsons | 96/29 R |
| 3,690,888 | 9/1972 | Bacon | 96/114 |
| 3,690,918 | 9/1972 | Miller | 96/94 BF |
| 3,692,753 | 9/1972 | Smith | 96/114 |
| 3,700,456 | 10/1972 | Smith | 96/114 |
| 3,706,564 | 12/1972 | Hollister | 96/114 |
| 3,706,565 | 12/1972 | Ericson | 96/114 |
| 3,843,364 | 10/1974 | Florena | 96/66 R |

*Primary Examiner*—Mary F. Kelley
*Attorney, Agent, or Firm*—A. W. Breiner

[57] ABSTRACT

A method is described for developing silver halide emulsions wherein development is activated by incorporating in the developing composition or the emulsion a homopolymer or copolymer comprising (meth-)acrylate or (meth)acrylamide units in which the ester linked or amide linked group contains at least one thioether sulphur atom.

9 Claims, No Drawings

DEVELOPMENT PROMOTING COMPOUNDS FOR SILVER HALIDE PHOTOGRAPHY

The present invention relates to silver halide photography, and more particularly, to the development of photograhic silver halide elements in the presence of compounds promoting the development.

It is known to increase the sensitivity of photographic emulsions by addition of chemical sensitizers e.g. sulphur-containing compounds, reducing agents and salts of gold or other noble metals or combinations of these compounds. Such chemical sensitizers are believed to react with the silver halide to form, on the surface of the silver halide, minute amounts of silver sulphide or of silver or of other noble metals which increases the sensitivity of the silver halide emulsion. This kind of chemical sensitization, however, reaches a limit beyond which further addition of sensitizer or further digestion with the sensitizer merely increases the fog of the emulsion with constant or decreasing speed.

As is known in the art, further increasing of the speed of the photographic reproduction system can be effected by the presence during development of alkylene oxide polymers and/or onium or polyonium compounds of the ammonium, phosphonium or sulphonium type. These compounds sensitize the emulsion by development acceleration and may be used either in the emulsion or the developer.

We have now found that development of gelatino silver halide emulsions can be activated by incorporating into the developing composition or into the gelatino silver halide emulsion a polymeric compound, which includes homopolymers as well as copolymers, comprising (meth)acrylate or (meth) acrylamide units in which the ester linked or amide linked group contains at least one sulphur atom linking two alkyl carbon atoms of the said group.

Preferred polymeric compounds comprise recurring units of the formula:

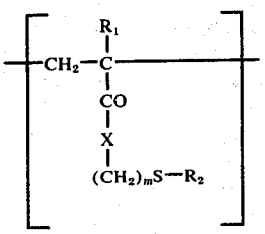

wherein:

$R_1$ is hydrogen or methyl,

X is O or NH, $m$ is an integer of 1 to 5, and $R_2$ is a $C_1$–$C_5$ alkyl group which, provided the polymeric compound is a homopolymer, may be substituted by a sulphogroup in acid or salt form.

Typical examples of such units can be derived from: N-(β-methylthioethyl)acrylamide, N-(β-ethylthioethyl)acrylamide, N-(β-isopropylthioethyl)acrylamide, N-(2-methyl-3-isopropylthiopropyl)acrylamide, N-(4-ethylthiobutyl)acrylamide, β-methylthioethyl acrylate, β-ethylthioethyl methacrylate, β-(β'-sulphoethylthio)ethyl acrylate, etc. Preference is given to N-(β-ethylthioethyl)acrylamide or methacrylamide and β-ethylthioethyl acrylate or methacrylate.

Apart from the above (meth)acrylate or (meth)acrylamide units with thioether linkages in the ester or amide portion, the polymeric compounds used in accordance with the present invention may also comprise units of at least one copolymerized ethylenically unsaturated monomer e.g. acrylic acid and methacrylic acid, acrylamide and methacrylamide, alkyl(meth) acrylates and sulphoalkyl(meth)acrylates e.g. sulphoethyl methacrylate, itaconic acid, N-vinylpyrrolidon, and the like. When it is intended to use the compound in the developing composition, the ethylenically unsaturated monomers are preferably selected to make the polymeric compound soluble in such compositions. However, the polymeric compounds need not necessarily be soluble in developing solutions when they are used therein since it is also possible to use aqueous dispersions (latexes) of the polymers prepared by emulsion polymerisation in water. The copolymers used in this invention comprise at least 5 % and preferably at least 25 % of the above units with thioether linkages.

Related polymeric compounds comprising (meth)acrylamide and (meth)acrylate units with thioether linkages in the side chain are known for use as silver halide peptizer in the precipitation of silver halide grains to wholly or partly replace the gelatin binder.

When used according to the present invention in silver halide emulsions the compounds are added as coating final after chemical ripening.

In accordance with the present invention, the polymeric compounds are preferably incorporated in the developer composition comprising a black-and-white developing agent e.g. hydroquinone, hydroquinone/1-phenyl-3-pyrazolidinone, hydroquinone/p-monomethylaminophenol sulphate or a colour developing agent more particularly an aromatic primary amino colour developing agent such as a p-phenylene diamine colour developing agent.

The present invention thus provides a developing composition for photographic silver halide elements containing developable silver halide, the said composition comprising one or more silver halide developing agents and a polymeric compound comprising units as defined above.

The present invention also provides a method of making a photographic gelatino silver halide emulsion which comprises the step of incorporating a polymeric compound as defined above in the said emulsion after chemical ripening.

Generally, the polymeric compounds used according to the present invention can be prepared by known solution or emulsion polymerisation procedures as is illustrated by the following preparations.

Preparation 1

Co-(acrylic acid/β-ethylthioethyl-acrylate)

In a 100 ml reaction vessel fitted with stirrer, reflux condenser, nitrogen inlet tube and thermometer, 8 g of β-ethylthioethylacrylate, 2 g of acrylic acid as well as 500 mg of azo-bis-isobutyronitrile were dissolved in ethanol until a volume of 100 ml was obtained.

The solution was refluxed while introducing nitrogen to obtain complete polymerisation after 8 hours. The pH of the viscous solution obtained, was adjusted to 7 by addition of 1N sodium hydroxide.

The ethanol was removed by evaporation under reduced pressure and the residual polymeric solution was diluted to 100 ml by means of water.

Copolymers prepared starting from 30, 40 and 50 % by weight of acrylic acid relative to the total amount of monomers were prepared in an analogous way.

Preparation 2 co(acrylamide/N-(β-ethylthioethyl)-acrylamide)

In a 1 liter reaction vessel fitted with stirrer, reflux condenser, nitrogen inlet tube and thermometer, 40 g of acrylamide, 60 g of N-(β-ethylthioethyl)acrylamide, 1 g of n-lauryl mercaptan and 2.5 g of azo-bis-isobutyronitrile were dissolved in a mixture of 400 ml of isopropanol and 100 ml of water.

The solution was rinsed with nitrogen and then heated to 80° C. In the first 10 minutes, the reaction was slightly exothermic and therefore the mixture had to be cooled. Then the mixture was heated for 8 hours at 75° C.

The copolymer was isolated from the homogeneous solution by pouring the solution with vigorous agitation into 3 liters of acetone.

The copolymer was washed with acetone and dried till constant weight in a ventilated drying chamber at 60° C. 91.0 g of water-soluble copolymer was obtained. It had an intrinsic viscosity, measured in water at 25° C, of 0.16 dl/g.

The copolymer prepared in an analogous way with 30 % by weight of acrylamide relative to the total amount of monomers was insoluble in water and alkali.

Preparation 3 co(acrylamide/β-ethylthioethyl-acrylate)

In a 2 liters reaction vessel fitted with stirrer, reflux condenser, nitrogen inlet tube and thermometer, 60 g of β-ethylthioethyl-acrylate, 140 g of acrylamide, 2 g of n-lauryl-mercaptan and 5 g of azo-bis-isobutyronitrile were dissolved in a mixture of 650 ml of isopropanol and 350 ml of water.

The solution was rinsed with nitrogen and heated to 75° C. The polycondensation reaction was slightly exothermic so that the temperature rose to 80° C. The solution was kept for 10 min at 80° C and then heated for 20 hours at 70° C.

The solution was concentrated by evaporation to a volume of 600 ml and then poured with vigourous stirring in 5 liters of methanol. The sticky residue was washed with 1 liter of methanol and then dissolved in water. 168 g of water-soluble and alkali-soluble copolymer were obtained. The intrinsic viscosity measured in water at 25° C was 0.244 dl/g.

Preparation 4 co(acrylic acid/N-(β-ethylthioethyl)acrylamide)

In a 250 ml reaction vessel fitted with stirrer, nitrogen inlet tube, reflux condenser and thermometer, 2 g of acrylic acid, 18 g of N-(β-ethylthioethyl)acrylamide, and 1 g of azobis-isobutyronitrile were dissolved in 200 ml of ethanol.

While stirring and introducing nitrogen, the solution was heated for 8 hours at 75° C. After addition of 25 ml of 1N sodium hydroxide and 50 ml of water the ethanol was removed by evaporation under reduced pressure.

The viscous solution was diluted with water to 200 ml thus forming a 10 % by weight aqueous solution of the polymer.

In an analogous way water-soluble copolymers were prepared from 20, 30, 40 and 50 % by weight of acrylic acid relative to the total amount of monomers.

Preparation 5 poly-(β-ethylthioethyl-acrylate) latex

A 500 ml reaction vessel was fitted with a stirrer, a reflux condenser, a thermometer, and two separate dropping funnels each fitted with a stirrer.

In the first dropping funnel 60 g of β-ethylthioethyl acrylate, 3 g of HOSTAPAL B (trade name of Hoechst A.G., W. Germany, for a surface active ethoxylated and sulphated alkylphenol) and 150 ml of water were emulsified whereas in the second dropping funnel 0.60 g of 4,4'-azo-bis(4-cyanovaleric acid) was dissolved in 90 ml of demineralised water.

42 ml of the emulsion and 18 ml of the solution were run simultaneously and at once into the reaction vessel and heated to 80° C with stirring.

The emulsion polymerisation reaction was slightly exothermic. After 10 min the residual contents of the dropping funnels were added simultaneously over a period of 40 min while maintaining the reaction temperature at 80° C.

The latex formed was then stirred for 4 hours at 80° C. After addition of 150 ml of water, residual monomer was removed by distilling off 200 ml with stirring under slightly reduced pressure and while introducing nitrogen.

Yield : 330 ml of latex comprising per 100 ml 15.6 g of polymer.

Preparation 6 co(ethyl acrylate/β-sulphoethyl methacrylate sodium salt/β-ethylthioethyl acrylate)

In a reaction vessel as described in preparation 5, 100 ml of a 10 % by weight aqueous solution of sodium oleyl methyl tauride and 100 ml of demineralized water were heated to 90° C while introducing nitrogen. The solution was kept for 10 min at this temperature while introducing nitrogen.

The first dropping funnel contained a solution of 10 g of β-sulphoethyl methacrylate sodium salt in 100 ml of water adjusted to pH 7 by means of 5N sodium hydroxide, and a 5 % by weight aqueous solution of 4,4'-azo-bis(4-cyanovaleric acid).

The second dropping funnel contained a monomer mixture of 80 g of ethyl acrylate and 10 g of β-ethylthioethyl acrylate.

One fourth of the volumes of both dropping funnels were run at once and simultaneously into the reaction vessel and the mixture was stirred at 84.5° C. After 6 min. the residues of both dropping funnels were added dropwise in 15 min.

The temperature of the reaction mixture was raised to 98° C and kept at this value for 2 hours. Residual monomer was removed from the viscous latex by distilling off 50 ml under slightly reduced pressure, with stirring and while introducing nitrogen.

Yield: 330 g of latex containing per 100 g 28.75 g of solids.

The development accelerating compounds can be utilized in various concentrations, depending upon the effects desired, the particular silver halide emulsions employed, the thickness of the emulsion layers, the concentration of silver halides in the emulsions, the concentration of developing agents in the developers, the pH of the developers, etc., as well as the particular polymeric compound itself especially the percentage of units with thioether linkages. The optimum amount for any given compound can be determined for any particular emulsion or developer by running a series of tests in which the quantity is varied over a certain range.

In general, useful results are obtained when the concentration of the thioether compound in the developer is from about 100 mg to about 20 g per liter. The activity of the developer will obviously depend upon the temperature of development, which may be room temperature or elevated temperature e.g. above 30° C, upon the duration of development and the like.

When incorporated in the emulsion, the compounds are generally used in concentrations varying from about 100 mg to about 10 g per mole of silver halide.

The polymeric compounds can be added to the emulsion or developer using any technique e.g. from a solution or dispersion in a suitable solvent. Of course the solvents used should have no harmful effect on the emulsion and generally solvents which are miscible with water are to be preferred. For example, the thioether compounds can be dissolved in water or solvents such as ethanol, acetone, pyridine, N,N-dimethylformamide, dimethyl sulphoxide, N-methylpyrrolidone, etc. It is also possible to incorporate latexes of the polymeric compounds formed by emulsion polymerisation in water.

If desired, the thioether compounds of the present invention can be treated with various alkylating agents e.g. the esters of an alcohol and a strong acid such as methyl or ethyl esters of sulphuric acid, phosphoric acid, hydrochloric acid, hydrobromic acid, hydroiodic acid, benzene sulphonic acid, p-toluene sulphonic acid, etc. to provide units in which the thioether group is converted into sulphonium groups. By the presence of the units with ternarized sulphonium groups in the side chain, improved solubility in water or various water-miscible solvents is obtained.

The silver halide emulsions which are developed in the presence of the polymeric compounds defined above, comprise as light-sensitive silver halide, silver bromide, silver iodide, silver chloride or mixed silver halides such as silver chlorobromide, silver chlorobromoiodide or silver bromoiodide. The emulsions can be chemically sensitized by any of the accepted procedures. The emulsions can be digested with naturally active gelatin or with sulphur-containing compounds such as allyl isothiocyanate, allyl thiourea or sodium thiosulphate. The emulsion can also be digested in the presence of reducing agents e.g. the tin compounds described in Belgian Pat. Specifications 493,464 and 568,687, the iminoaminomethane sulphinic acid compounds described in United Kingdom Pat. Specification 789,823, polyamines e.g. diethylene triamine, spermine and bis($\beta$-aminoethyl)sulphide. They can further be digested in the presence of noble metal compounds such as ruthenium, rhodium, palladium, iridium, platinum and gold compounds as described by R. Koslowsky, Z.Wiss.Phot. 46, 65–72 (1951). Representative compounds are ammonium chloropalladate, potassium chloroplatinate, sodium chloropalladite, potassium chloroaurite, potassium aurithiocyanate, potassium chloroaurate, gold(III) chloride, gold(I) sulphide, etc.

The emulsions can comprise emulsion-stabilizers and fog-inhibiting compounds e.g. the mercury compounds such as those described in Belgian Pat. Specifications 524,121 and 677,337 and in published Dutch Patent Application 67/15932, organic sulphur-containing compounds that form insoluble silver salts with silver ions, heterocyclic nitrogen-containing thioxo compounds or derivatives thereof, e.g. benzothiazoline-2-thione, 1-phenyl-2-tetrazoline-5-thione and 2-ethoxycarbonylthio-5-amino-thiadiazole, the compounds described in Belgian Pat. Specifications 571,916 and 571,917, thiazolinium compounds of the type described in Product Licensing Index, December 1971 issue, p. 90–91, benzothiazolium compounds e.g. 2,3-dimethyl-5-methoxycarbonyl benzthiazolium p-toluene sulphonate and tetra- or pentaazaindenes especially those substituted by hydroxyl or amino groups e.g. those described by Birr, Z.Wiss.Phot. 47, 2-58 (1952). A very effective azaindene emulsion stabilizer is 5-methyl-7-hydroxy-s-triazolo[1,5-a]pyrimidine which can be used together with other emulsion stabilizers e.g. those of the type described above.

The emulsions may be X-ray and other non-spectrally sensitized emulsions as well as orthochromatic, panchromatic or infrared sensitive emulsions. The emulsions may be spectrally sensitized by means of neutrocyanines carboxycyanines, rhodacyanines, hemicyanines, merocyanines, oxonol dyes, styryl dyes and the like as described by F. M. Hamer in "The cyanine dyes and related compounds" (1954).

The emulsions may further comprise other compounds that sensitize the emulsion by development acceleration e.g. alkylene oxide polymers. These alkylene oxide polymers may be of various type e.g. polyethylene glycol having a molecular weight of 1500 or more, alkylene oxide condensation products or polymers as described in U.S. Pat. Nos. 1,970,578 - 2,240,472 - 2,423,549 - 2,441,389 - 2,531,832 and 2,533,990 and in U.K. Pat. Nos. 920,637 - 940,051 - 945,340 - 991,608 and 1,015,023. These development accelerating compounds may also be present in the silver halide developing solution. Other development accelerating compounds are onium and polyonium compounds preferably of the ammonium, phosphonium and sulphonium type.

Other addenda e.g. hardening agents such as formaldehyde, mucochloric and mucobromic acid, dialdehydes, etc., wetting agents, plasticizers, matting agents, e.g. polymethyl methacrylate and silica particles, light-screening dyes, etc., may be present in the silver halide emulsion or another layer of the light-sensitive materials used according to the invention.

The compounds of the present invention may be used for various kinds of photographic silver halide elements. They can be used for the black-and-white development as well as the colour development of photograhic silver halide elements. In addition to being useful for negative processing they may also be used for reversal processing. In reversal processing where after a first black-and-white development residual silver halide is rendered developable by uniform re-exposure or by a chemical treatment and then developed by a second development which may be black-and-white or colour, the compounds of the invention are preferably used in the second developer so that development of the residual silver halide rendered developable is activated and thus maximum density is increased.

The thioether compounds of the present invention have been found particularly useful for the development of photographic colour emulsions. They can be used in the production of multicolour images as well as in the production of monochromic images e.g. monochromic radiographic dye images according to the technique described in U.S. Pat. No. 3,734,735 and U.S. Pat. application Ser. No. 210,566 (= published German Pat. Application No. 2,165,193).

As is known in the art of silver halide colour photograhy, dyestuff images are formed by coupling of appropriate colour forming couplers with the oxidation products of aromatic primary amino colour developers particularly p-phenylene diamine colour developing agents. By the presence during the colour development of the novel development accelerators, the maximum density of the dyestuff images as well as the contrast can be increased which results in improved colour saturation. Moreover, in addition to having a favourable development accelerating action, these compounds do not give rise to difficulties in the subsequent bleaching of the silver image as often occurs when using development accelerating onium compounds e.g. quaternary ammonium compounds.

In multilayer photographic elements used in colour photography for the reproduction of multicolour images there are generally three selectively sensitive emulsion layers (each of which may consist of several strata finished to different speed levels) coated on the same side of a photographic support, such as film or paper. Such multilayer elements can also have other layers for special purposes including gelatin or other subbing layers, antihalation layers, protective coatings, etc.

The three selectively sensitive emulsion layers are a blue-sensitive emulsion layer, an emulsion layer sensitized to the green region of the spectrum and an emulsion layer sensitized to the red region of the spectrum. In as much as many photograhic silver halide emulsions have an inherent blue sensitivity, the photographic elements generally have a yellow filter layer beneath the blue-sensitive uppermost emulsion layer for the purpose of absorbing substantially all blue radiation which would otherwise be transmitted to the green- and red-sensitized emulsion layers.

Though the invention is primarily concerned with colour materials comprising the colour-forming couplers within the silver halide emulsions, the materials may also be of the type well known in the art and designed for processing in developers which contain the colour forming couplers within the colour developer. The colour-forming couplers are of the customary types employed in colour photography, such as pyrazolone couplers for formation of the magenta image, phenolic or naphtholic couplers for formation of the cyan image and open-chain compounds containing a reactive methylene group for formation of the yellow image.

When the multicolour elements have incorporated colour couplers the blue-sensitive emulsion layer comprises the yellow-forming colour coupler, the green-sensitized emulsion layer comprises the magenta-forming colour coupler and the red-sensitized emulsion layer comprises the cyan-forming colour coupler.

For the incorporation of the colour forming couplers in the silver halide emulsions, the conventional methods can be applied, e.g. they can be incorporated from solutions in high-boiling sparingly water-miscible solvents such as di-n-butyl phthalate and tricresyl phosphate or in low-boiling sparingly water-miscible solvents such as ethyl acetate, methylene chloride and chloroform, etc. or mixtures thereof. For this purpose these solutions are dispersed in extremely fine droplets, preferably in the presence of a wetting or dispersing agent into the hydrophilic colloid medium, the low-boiling sparingly water-miscible solvent then being removed by evaporation. Of course other techniques known by those skilled in the art for incorporating colour couplers, into colloid compositions can be used. For instance, the water-soluble colour couplers i.e. those containing a water-solubilizing sulpho group, in acid or salt form, can be incorporated into the coating composition of the layer in question from an aqueous or alkaline solution.

The hydrophilic colloid composition into which the colour couplers are dispersed or dissolved need not necessarily be the coating composition itself of the silver halide emulsion layer into which the colour couplers are intended to be present. The compounds may advantageously be first dispersed or dissolved in an aqueous non-light-sensitive hydrophilic colloid solution whereupon the resultant mixture after the occasional removal of the organic solvents employed, is intimately mixed with the said coating composition of the light-sensitive silver halide emulsion layer just before coating.

For more details about particularly suitable techniques that may be employed for incorporating colour couplers into a silver halide emulsion layer of a photographic material there can be referred to e.g. U.S. Pat. Nos. 2,269,158 - 2,284,887 - 2,304,939 - 2,304,940 and 2,322,027, U.K. Pat. Nos. 791,219 - 1,098,594 - 1,099,414 - 1,099,415 - 1,099,416 and 1,099,417, French Pat. No. 1,555,663, Belg. Pat. No. 722,026, Ger. Pat. No. 1,127,714 and to U.K. Pat. Application No. 14,763/69.

In the colour development aromatic primary amino developing substances are used, which are capable of forming azomethine dyes by coupling in their oxidized form with the colour-forming couplers. Suitable developing agents are more particularly p-phenylene diamine and derivatives thereof e.g. N,N-dialkyl-p-phenylene diamines, N,N-dialkyl-N'-sulphomethyl-p-phenylenediamine, N,N-dialkyl-N'-carboxymethyl-p-phenylenediamine, the sulphonamido substituted p-phenylene diamines disclosed in U.S. Pat. No. 2,548,574 and other substituted p-phenylene diamines disclosed in U.S. Pat. No. 2,566,271.

Typical examples of p-phenylenediamines are N,N-diethyl p-phenylene diamine, 2-amino-5-diethylaminotoluene, N-butyl-N-sulphobutyl-p-phenylene diamine, 2-amino-5-[N-ethyl-N(β-methylsulphonamido)ethyl]aminotoluene, N-ethyl-N-β-hydroxyethyl-p-phenylenediamine, etc. These developing agents are used usually in their salt form such as the hydrochloride or sulphate.

The following examples illustrate the present invention.

EXAMPLE 1

A 35 mm strip of a commercially available multicolour reversal film material (Gevachrome Original T 600 film marketed by Agfa-Gevaert N.V., Mortsel, Belgium) was exposed through a grey continuous wedge to white light in a Hernfeld Sensitometer.

The exposed strip was then processed as follows :

treatment for 10 seconds at 25° C in a pre-bath of the following composition :

| | |
|---|---|
| water | 800 ml |
| ethylene diamine tetraacetic acid tetrasodium salt | 2 g |
| anhydrous sodium sulphate | 100 g |
| borax | 15 g |
| water to make | 1000 ml (pH 9.30) |

rinsing for 15 seconds and brushing of the back to remove antihalation layer;

developing for 3 min. 45 sec. at 25° C in a black-and-white developer of the following composition:

| | |
|---|---|
| N-methyl-p-aminophenol sulphate | 3 g |
| hydroquinone | 6 g |
| sodium metabisulphite | 0.5 g |
| sodium hexametaphosphate | 2 g |
| sodium sulphite | 50 g |
| anhydrous sodium carbonate | 40 g |
| potassium bromide | 2.3 g |
| potassium thiocyanate | 2.5 g |
| potassium iodide | 6 mg |
| water to make | 1000 ml (pH 10.2) |

treatment for 2 minutes in a stop bath of the following composition:

| | |
|---|---|
| potassium alum | 15 g |
| boric acid | 6 g |
| sodium hydrogen diacetate | 15 g |
| sodium metabisulphite | 1 g |
| water to make | 1000 ml (pH 4.2) |

rinsing with water for 3 minutes and overall re-exposing the material for 1 minute at 25° C;

colour developing for 4 minutes at 25° C in a colour developer of the following composition:

| | |
|---|---|
| sodium hexametaphosphate | 1 g |
| sodium sulphite | 4 g |
| anhydrous sodium carbonate | 25 g |
| potassium bromide | 2.2 g |
| sodium hydroxide | 0.6 g |
| hydroxylamine hydrochloride | 1.2 g |
| N,N-diethyl-p-phenylene diamine hydrochloride | 2.7 g |
| potassium iodide | 4 mg |
| water to make | 1000 ml (pH 10.7) |

rinsing with water for 10 sec. at 25° C;

fixing for 3 minutes at 25° C in the following fixing solution:

| | |
|---|---|
| potassium alum | 15 g |
| acid sodium sulphate | 13 g |
| sodium acetate trihydrate | 25 g |
| sodium bisulphite | 12 g |
| sodium thiosulphate | 200 g |
| water to make | 1000 ml (pH 3.9) |

rinsing with water for 2 min. at 25° C;

silver bleaching for 4 min. at 25° C in the following bleach bath:

| | |
|---|---|
| potassium bromide | 15 g |
| potassium alum | 45 g |
| acid potassium sulphate | 2 g |
| sodium acetate trihydrate | 5 g |
| sodium hydrogen diacetate | 10 g |
| potassium hexacyanoferrate(III) | 75 g |
| water to make | 1000 ml (pH 3.9) |

rinsing with water for 3 min. at 25° C, treating for 3 min. at 25° C in the above fixing solution, rinsing with water for 5 min. at 25° C, and stabilizing for 8 sec. at 25° C in a stabilizing bath comprising per liter 13 ml of a 40% aqueous formaldehyde solution and a wetting agent.

A second strip of the above 35 mm reversal colour film was exposed and processed under identical circumstances as the first strip, with the only difference that the colour developer now also contained per liter 100 mg of the polymeric compound of preparation 1.

The sensitometric results attained are listed in the following table. The values given for the gradation are the average gradients of the characteristic curve measured over an exposure range of $\Delta \log It = 0.60$ beginning at the point corresponding to density 0.70 above fog.

Table

| | Fog | | | Maximum density | | | Gradation | | |
|---|---|---|---|---|---|---|---|---|---|
| Strip | blue | green | red | blue | green | red | blue | green | red |
| 1 | 0.12 | 0.10 | 0.07 | 1.85 | 1.97 | 2.52 | 1.52 | 1.33 | 1.66 |
| 2 | 0.12 | 0.11 | 0.07 | 2.50 | 2.46 | 2.90 | 2.30 | 1.95 | 2.00 |

The above results show that when colour development takes place in the presence of a compound according to the present invention, higher contrast and higher maximum density are obtained. The selectivity of colour reproduction is also favourable.

EXAMPLE 2

Example 1 was repeated with the difference that now 800 mg of the polymeric compound of preparation 3 was added per liter of colour developer in the development of strip 2.

The sensitometric results are listed in the following table.

Table

| | Fog | | | Maximum density | | | Gradation | | |
|---|---|---|---|---|---|---|---|---|---|
| Strip | blue | green | red | blue | green | red | blue | green | red |
| 1 | 0.15 | 0.11 | 0.07 | 1.90 | 2.20 | 2.48 | 1.33 | 1.34 | 1.54 |

Table-continued

| | Fog | | | Maximum density | | | Gradation | | |
|---|---|---|---|---|---|---|---|---|---|
| Strip | blue | green | red | blue | green | red | blue | green | red |
| 2 | 0.15 | 0.11 | 0.07 | 2.10 | 2.38 | 2.58 | 1.67 | 1.68 | 1.72 |

EXAMPLE 3

Example 1 was repeated with the difference that now 800 mg of the polymeric compound of preparation 4 was added per liter of colour developer in the development of strip 2.

The sensitometric results are listed in the following table.

Table

| | Fog | | | Maximum density | | | Gradation | | |
|---|---|---|---|---|---|---|---|---|---|
| Strip | blue | green | red | blue | green | red | blue | green | red |
| 1 | 0.12 | 0.10 | 0.07 | 2.05 | 2.35 | 2.71 | 1.59 | 1.51 | 1.70 |
| 2 | 0.13 | 0.09 | 0.06 | 2.67 | 2.79 | 3.32 | 2.37 | 2.08 | 2.20 |

EXAMPLE 4

Example 1 was repeated with the difference that the 35 mm commercially available multicolour reversal film material was Gevachrome Original T 605 film marketed by Agfa-Gevaert N.V., Mortsel, Belgium and that in the development of two strips (strips 2 and 3) 20 g of the polymeric compounds of preparations 5 and 6 respectively were added per liter of colour developer.

The sensitometric results are listed in the table.

Table

| | Fog | | | Maximum density | | | Gradation | | |
|---|---|---|---|---|---|---|---|---|---|
| Strip | blue | green | red | blue | green | red | blue | green | red |
| 1 | 0.13 | 0.09 | 0.06 | 2.06 | 2.25 | 2.84 | 1.57 | 1.73 | 2.25 |
| 2 | 0.13 | 0.09 | 0.07 | 2.92 | 2.84 | 3.38 | 2.45 | 2.38 | 3.45 |
| 3 | 0.12 | 0.09 | 0.06 | 2.43 | 2.45 | 2.80 | 2.04 | 2.02 | 2.36 |

EXAMPLE 5

A high speed silver bromoiodide emulsion (5 mole % of iodide) comprising a colour coupler of the formula:

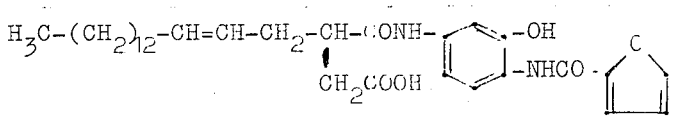

suitable for radiographic colour photography as described in U.S. Pat. No. 3,734,735 was coated at both sides of a subbed polyethylene terephthalate support so that an amount of silver halide equivalent to about 9 g of silver nitrate was present per sq.m.

The comparison element A thus formed as well as an element B formed in a similar way but containing in the emulsion layers per sq.m. 50 mg of the polymeric compound of preparation 3 were exposed through a wedge and processed, which includes colour development, fixing, rinsing and drying, at 37° C in 3 min 30 sec. The colour development (45 sec) occurred by means of a composition comprising per liter 8 g of N-hydroxyethyl-N-ethyl-p-phenylene diamine, 1.5 g of hydroxylamine, 4 g of anhydrous sodium sulphite, 1 g of potassium bromide, 65 g of anhydrous potassium carbonate, an antifoggant such as 5-nitrobenzimidazole as well as a polyoxyalkylene bispyridinium development accelerator.

The sensitometric values obtained are listed in the following table.

Table

| Element | Fog | Relative speed | Gamma |
|---|---|---|---|
| A | 0.10 | 100 | 2.00 |
| B | 0.07 | 123 | 2.00 |

The element of the invention thus showed improved speed and fog for a same gamma value.

When the exposed elements were subjected to a 90 second's black-and-white processing at 38° C using a developer (22 sec) comprising per liter : 12 g of p-monomethylaminophenol sulphate, 80 g of anhydrous sodium sulphite, 35 g of hydroquinone, 30 g of sodium hydroxide and 20 g of potassium bromide.

The following sensitometric results were attained.

| Element | Fog | Relative speed | Gamma |
|---|---|---|---|
| A | 0.07 | 100 | 2.30 |
| B | 0.10 | 214 | 1.95 |

The above results again show the development activating effect of the compounds of the invention.

We claim:

1. Improved method of development of an imagewise exposed photographic element containing a developable chemically sensitized gelatino silver halide emulsion layer wherein development occurs in the presence of a polymeric compound comprising recurring (meth- )acrylate or (meth)acrylamide units having the formula:

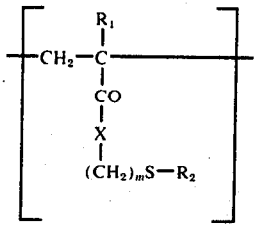

wherein:

$R_1$ is hydrogen or methyl,

X is oxygen or NH,

*m* is an integer of 1 to 5, and $R_2$ is a $C_1$-$C_5$ alkyl group, which may be substituted by sulpho in acid or salt form when the polymer is a homopolymer, the polymeric compound having been incorporated in the developing composition or in the chemically sensitized gelatino silver halide emulsion in an amount at from about 100 mg to about 20 g per liter or at from about 100 mg to about 10 g per mole of silver halide, which is sufficient to enhance the development of said photographic element.

2. Method according to claim 1, wherein the recurring units correspond to the formula:

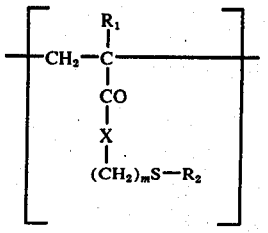

wherein:

$R_1$ is hydrogen or methyl,

X is oxygen or NH,

*m* is an integer of 1 to 5, and $R_2$ is a $C_1$-$C_5$ alkyl group, which may be substituted by sulpho in acid or salt form when the polymer is a homopolymer.

3. Method according to claim 2, wherein the recurring units are units of N-(β-ethylthioethyl) acrylamide or methacrylamide or β-ethylthioethyl acrylate or methacrylate.

4. Method according to claim 1, wherein the polymeric compound is a homopolymer.

5. Method according to claim 1, wherein the polymeric compound is a copolymer comprising at least 25% of the said units.

6. Method according to claim 5, wherein the said copolymer is one in which the units of copolymerised monomer are (meth)acrylic acid or (meth)acrylamide units.

7. Method according to claim 1, wherein the polymeric compound is present in the developing composition.

8. Method according to claim 1, wherein the photographic element is a colour element of the type having incorporated colour couplers and development occurs by means of an aromatic primary amino colour developing agent.

9. Method according to claim 8, wherein the colour developing agent is a p-phenylene diamine colour developing agent.

* * * * *